US009267214B2

(12) United States Patent
Reddy et al.

(10) Patent No.: US 9,267,214 B2
(45) Date of Patent: Feb. 23, 2016

(54) ALUMINUM RECOVERY PROCESS

(75) Inventors: Ramana G. Reddy, Tuscaloosa, AL (US); Mingming Zhang, Tuscaloosa, AL (US)

(73) Assignee: Board of Trustees of the University of Alabama, Tuscaloosa, AL (US)

( * ) Notice: Subject to any disclaimer, the term of this patent is extended or adjusted under 35 U.S.C. 154(b) by 382 days.

(21) Appl. No.: 12/867,143

(22) PCT Filed: Feb. 10, 2009

(86) PCT No.: PCT/US2009/000827

§ 371 (c)(1), (2), (4) Date: Aug. 11, 2010

(87) PCT Pub. No.: WO2009/102419

PCT Pub. Date: Aug. 20, 2009

(65) Prior Publication Data

US 2011/0000782 A1 Jan. 6, 2011

Related U.S. Application Data

(60) Provisional application No. 61/027,695, filed on Feb. 11, 2008.

(51) Int. Cl.

| | |
|---|---|
| ***C25C 3/00*** | (2006.01) |
| ***C25C 3/06*** | (2006.01) |
| ***C25C 3/08*** | (2006.01) |
| ***C25C 7/02*** | (2006.01) |
| ***C25C 3/24*** | (2006.01) |
| ***C25C 3/18*** | (2006.01) |

(52) U.S. Cl.
CPC .... *C25C 3/24* (2013.01); *C25C 3/18* (2013.01)

(58) Field of Classification Search
CPC ..... C25C 3/06; C25C 3/08; C25C 3/12; C25C 3/00; C25C 7/02
USPC ..... 205/372, 233, 237, 364
See application file for complete search history.

(56) References Cited

U.S. PATENT DOCUMENTS

| | | | | |
|---|---|---|---|---|
| 4,050,999 | A * | 9/1977 | Johnson | 205/393 |
| 4,764,257 | A * | 8/1988 | Sadoway | 205/336 |
| 5,516,353 | A * | 5/1996 | Sahai et al. | 75/10.1 |
| 2004/0238352 | A1 * | 12/2004 | Wu et al. | 204/259 |
| 2007/0278106 | A1 * | 12/2007 | Shaw | 205/372 |
| 2009/0236227 | A1 * | 9/2009 | Kuzmanovic et al. | 205/80 |

OTHER PUBLICATIONS

Anderson et al., "Structure and Properties of High Stability Geminal Dicationic Ionic Liquids," *J. Amer. Chem. Soc.*, 127(2):593-604 (2005).

Arenas et al., "Corrosion of Steel in Ionic Liquids," *J. Mining and Metallurgy B*, 39(1-2)B:81-91 (2003).

(Continued)

*Primary Examiner* — Zulmariam Mendez

(74) *Attorney, Agent, or Firm* — Meunier Carlin & Curfman LLC

(57) ABSTRACT

Disclosed are processes and electrolytic cells that can be used to extract and thereby recover aluminum from aluminum-containing waste, including an aluminum dross that is suitable for disposal in a land-fill. The disclosed processes and cells use ionic liquids as an electrolyte.

30 Claims, 1 Drawing Sheet

(56) References Cited

OTHER PUBLICATIONS

Holbrey et al., "Heat Capacities of Ionic Liquids and Their Applications as Thermal Fluids," *Ionic Liquids as Green Solvents: Progress and Prospects*, edited by: R D. Rogers and K. R Seddon, ACS Symposium Series 856, American Chemical Society, New York, pp. 121-133 (2003).
Holbrey et al., "Mercury(II) Partitioning from Aqueous Solutions with a New, Hydrophobic Ethylene-Glycol Functionalized Bis-Imidazolium Ionic Liquid," *Green Chem*., 5:129-135 (2003).
Kamavaram et al., "Thermal Stabilities of Di-alkylimidazolium Chloride Ionic Liquids," *Int'l Journal of Thermal Sciences*, 47:773-777 (2008).
Kamavaram et al., "Aluminum Extraction in Ionic Liquids at Low Temperature," *Advanced Processing of Metals and Materials*, edited by F. Kongoli and R. G. Reddy, TMS, Warrendale, USA, 4:97-108 (2006).
Kamavaram et al., "Recycling of Aluminum Metal-Matrix Composite using Ionic Liquids: Effects of process variables on current efficient and deposit characteristics," *Electrochimica Acta*, 50(16-17):3286-3295 (2005).
Kamavaram et al., "Aluminum Electrolysis in Ionic Liquids at Low Temperature," *Metal Separation Technologies III*, Proceedings of the Symposium in Honour of Professor Lauri E. Holappa of the Helsinki University of Technology, Cooper Mountain, CO, edited by R. E. Aune and M. Kekkonen, pp. 143-151 (Jun. 20-24, 2004).
Kamavaram et al., "Electrorefining of Aluminum Alloy in Ionic Liquids at Low Temperatures," *Journal of Mining and Metallurgy*, 39(1-2)B:43-58 (2003).
Kamavaram et al., "Physical and Thermal Properties of Ionic Liquids Used in Aluminum Electrorefining at Low Temperatures," *Aluminum 2003*, Proceedings of the TMS 2003 Annual Meeting, San Diego, CA, edited by Ed. S. K. Das, (Warrendale, PA: TMS, 2003), pp. 299-307 (Mar. 2-6, 2003).
Kamavaram et al., "Electrorefining of Aluminum in $C_6$mimCI+AICh$_3$ Ionic Liquids at Near Room Temperature," *Molten Salts XIII 2002*, edited by H. C. Delong, R W. Bradshaw, M. Matsunaga, G. R. Stafford, and P. C. Trulove, ECS, pp. 840-846 (2002).
Kamavaram et al., "Recycling of Aluminum Based Materials in Ionic Liquids," *Recycling and Waste Treatment in Mineral and Metal Processing: Technical and Economic Aspects Proceedings*, TMS Fall 2002 Extraction and Processing Division Meeting, Luleå, Sweden, edited by B. Bjorkman, C. Samuelsson, and 1. O. Wikstrom, TMS, MEFOS, 2:517-526 (Jun. 16-20, 2002).
Kamavaram et al., "Recycling of AI-MMC in Ionic Liquids at Near Room Temperature," *ICCE/9, Proceedings of International Conference on Composites Engineering*, edited by David Hui, University of New Orleans, USA, pp. 359-360 (2002).
Kamavaram et al., "Electrochemical Studies of Aluminum Deposition in Ionic Liquids at ambient Temperatures," *Light Metals*, edited by W. Schneider, TMS, pp. 253-258 (2002).
Kim et al., "Recent Advances in Electrodeposition Technology," *Journal of the Korean Institute of Surface Eng*., 34(6):553-567 (2001).
Reddy, "Ionic Liquids: How well do we know them?" *Journal of Phase Equilibria and Diffusion*, 27(3):210-211 (2006).
Reddy, "Emerging Technologies in Extraction and Processing of Metals," *2002 Extraction and Processing Distinguished Lecture*, Metallurgical and Materials Transactions B, 34B:137-152 (2003).
Wu et al., "Novel Ionic Liquid Thermal Storage for Solar Thermal Electric Power Systems," *Forum 2001, Solar Energy: The Power to Choose*, Proceedings of Solar Forum 2001, Washington, D.C., edited by R Cambell-Howe, ASES, (CD), pp. 1-7 (Apr. 21-25, 2001).
Wu et al., "Aluminum Reduction via Near Room Temperature Electrolysis in Ionic Liquids," *Light Metals 2001*, edited by J. L. Anjier, TMS, pp. 237-243 (2001).
Wu et al., "Aluminum Recycling via Room Temperature Electrolysis in Ionic Liquids," *Recycling of Metals and Engineered Materials*, edited by D. L. Stewart, JI., J. C. Daley and R L. Stephens, TMS, pp. 845-856 (2000).
Zhang et al., "C0$_2$ Free Electrochemical Process for Production of Light Metals Using Ionic Liquids as Electrolytes," *Carbon Dioxide Reduction Metallurgy*, edited by N. R. Neelameggham and R. G. Reddy, TMS, Warrendale, USA, pp. 161-170 (2008).
Zhang et al., "Evaluation of Ionic Liquids as Heat Transfer Materials in Thermal Storage Systems," *Energy: Energy Materials*, editors: F. Dogan, M. Awano, D. Singh and B. Tuttle, ASM International, Materials Park, Ohio, USA MS&T'07, pp. 151-160 (Sep. 16-20, 2007).
Zhang et al., "Modeling of Low Temperature Aluminum Electrowinning in Chloroaluminate Ionic Liquid Electrolytes," Proceedings International Conference, *Advances in Metallurgical Processes and Materials*, National Metallurgical Academy, Ukraine, Dnepropetrovsk, Ukraine, 2:15-29 (2007).
Zhang et al., "Ionic Liquid Metallurgy: Novel Electrolytes for Metals Extraction and Refining Technology," *Minerals & Metallurgical Processing*, 23(4):177-186 (2006).
Zhang et al., "Electrical Field and Current Density Distribution Modeling of Aluminum Electrodeposition in Ionic Liquid Electrolytes," *ECS Trans*., 1(16):47-60 (2006).
Zhang et al., "Aluminum Extraction Via Batch Recirculation Electrolysis in Ionic Liquids," *Advanced Processing of Metals and Materials*, edited by: F. Kongoli and R. G. Reddy, TMS, Warrendale, 4:237-246 (2006).
Zhang et al., "Ionic Liquids Electrowinning of Aluminum in Batch Mode Cells," *Light Metals*, edited by T. Galloway, TMS, Warrendale, USA, pp. 451-455 (2006).
Zhang et al. "Thermodynamic Properties of 1-butyl-3-methylimidazolium chloride ($C_4$mim[C1]) Ionic Liquid," *J. Phase Equilibria and Diffusion*, 26(2):124-130 (2005).
Zhang et al., "Application of Fluorinated Ionic Liquids in the Extraction of Aluminum," *Light Metals 2004*, edited by A. Tebereaux, TMS, Warrendale, PA, pp. 315-319 (2004).
Zhang et al., "New Electrolytes for Aluminum Electrodeposition: Ionic Liquids," *JOM*, 11:54-57 (2003).
Zhang et al. "Recycling of Aluminum Alloy Waste via Ionic Liquid Electrolytes," *Green Engineering for Materials Processing*, edited by H. Kaminsky, S. Marra, C. Jantzen, R. Asfahani, MS&T, ASM International, Materials Park, OH, USA, pp. 153-161 (2006).
Zhang et al., "Thermal Stability of Ionic Liquids," *Fundamentals of Advanced Materials for Energy Conversion*, edited by D. Chandra and R G. Bautista, TMS, pp. 33-39 (2002).

* cited by examiner

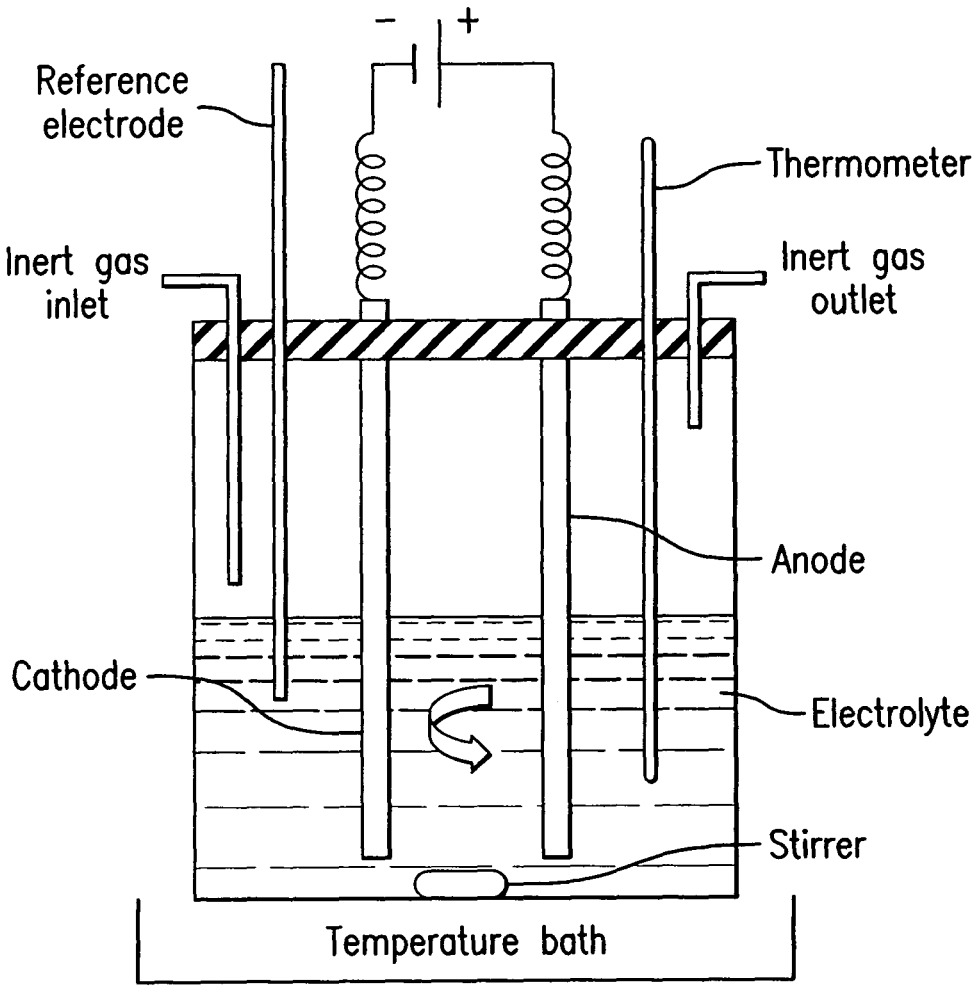
-
+
Reference electrode
Thermometer
Inert gas inlet
Inert gas outlet
Anode
Cathode
Electrolyte
Stirrer
Temperature bath

ALUMINUM RECOVERY PROCESS

FIELD OF THE DISCLOSURE

Disclosed are processes and electrolytic cells that can be used to extract and thereby recover aluminum from aluminum-containing waste, including aluminum-comprising dross that is suitable for disposal in a land-fill. The disclosed processes and cells use ionic liquids as an electrolyte.

BACKGROUND

Aluminum is the most abundant metal found on earth, the oxides and silicates of which comprise about 8% of the earth's crust. A total of about 29 million tons of aluminum is needed to meet worldwide demand each year. About 22 million tons of this total is new aluminum and 7 million tons is from aluminum scrap that is recycled for reuse. Thus, about 25% of the total amount of aluminum used worldwide is recycled. Of the 22 million tons of new aluminum produced every year only 50% is ever recycled.

New aluminum is made from bauxite by way of the Hall-Heroult process that involves electrolysis of alumina ($Al_2O_3$) to aluminum metal. The large electrolysis operations that produce aluminum metal typically run continuously 24 hours a day, seven days a week. A modern smelter typically costs on the order of $1.6 billion. It has been estimated that 1% of the energy generated in the United States and 3% of the world's energy is used in making aluminum metal.

Although the electrical voltage used in alumina ore smelters is typically only about 5.15 volts, the amount of current necessary is in the range of 100,000 to 150,000 amperes. In addition, the electrolytic smelting process in carried out at a temperature of about 900° C. The majority of aluminum produced has a purity of 99.7%, however, super pure aluminum having a purity of 99.99% is required for special applications wherein high ductility or conductivity is required. Although these purity differences appear marginal, the difference in properties between the two grades is significant.

In addition to the high energy cost to produce aluminum, the electrolyte used in the Hall-Heroult process, cryolite (sodium aluminum fluoride, $Na_3AlF_6$), is an uncommon mineral of very limited natural distribution; it is only found in large quantities on the west coast of Greenland. The cost of obtaining aluminum from the Hall-Heroult process is therefore increased because of the need to synthesize large quantities of cryolite.

The production of secondary aluminum from alloy requires only 5-20% of the energy that is need for the production of primary aluminum from bauxite. The conventional method for recycling either aluminum metal scrap, for example, shavings, or processed aluminum, for example, aluminum cans, involves sizing the scrap followed by compacting. However, the conventional process requires melting aluminum at high temperatures in addition to degreasing and other cleaning steps. High temperature processes result in the loss of aluminum metal from burning.

However, conventional aluminum production methods, as well as recycling processes, produce a large quantity of aluminum dross that is typically skimmed off the top of the aluminum melt and discarded. State of the art dross recycling processes select only the largest pieces of material for processing and therefore recover only from 3-10% of the aluminum. However, these dross recycling processes also involve a large consumption of energy per pound of purified aluminum obtained. In addition, conventional smelting process which recover aluminum metal from dross, also produce dross having a substantial amount, but a lower concentration, of aluminum metal.

There is therefore a long felt need for a process that is suitable for obtaining aluminum from the dross formed during both the primary smelting process, as well as during recycling processes.

SUMMARY

Disclosed are electrolytic cells for recovering aluminum metal from aluminum-comprising dross. The disclosed cells can be adapted for either a batch process for recovery of aluminum or for a continuous process for recovery of aluminum.

Further disclosed are methods for recovering aluminum metal from dross. A first embodiment relates to a batch process wherein the anode comprises aluminum-comprising dross. A further embodiment comprises a process wherein aluminum-comprising dross is continuously fed into the electrolytic cell.

BRIEF DESCRIPTION OF THE FIGURES

FIG. 1 depicts one example of the disclosed electrolytic cells comprising an anode, a cathode, a reference electrode, and means for heating the cell and for introducing an inert atmosphere.

DETAILED DISCLOSURE

The materials, compounds, compositions, articles, and methods described herein may be understood more readily by reference to the following detailed description of specific aspects of the disclosed subject matter and the Examples included therein and to the Figures.

Before the present materials, compounds, compositions, articles, and methods are disclosed and described, it is to be understood that the aspects described below are not limited to specific synthetic methods or specific reagents, as such may, of course, vary. It is also to be understood that the terminology used herein is for the purpose of describing particular aspects only and, unless a particular term is specifically defined herein, is not intended to be limiting.

Also, throughout this specification, various publications are referenced. The disclosures of these publications in their entireties are hereby incorporated by reference into this application in order to more fully describe the state of the art to which the disclosed matter pertains. The references disclosed are also individually and specifically incorporated by reference herein for the material contained in them that is discussed in the sentence in which the reference is relied upon.

DEFINITIONS

Throughout the description and claims of this specification the word "comprise" and other forms of the word, such as "comprising" and "comprises," means including but not limited to, and is not intended to exclude, for example, other additives, components, integers, or steps.

As used in the description and the appended claims, the singular forms "a," "an," and "the" include plural referents unless the context clearly dictates otherwise. Thus, for example, reference to "a composition" includes mixtures of two or more such compositions, reference to "an ionic liquid"

includes mixtures of two or more such ionic liquids, reference to "the compound" includes mixtures of two or more such compounds, and the like.

"Optional" or "optionally" means that the subsequently described event or circumstance can or cannot occur, and that the description includes instances where the event or circumstance occurs and instances where it does not.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed, then "less than or equal to" the value, "greater than or equal to the value," and possible ranges between values are also disclosed, as appropriately understood by the skilled artisan. For example, if the value "10" is disclosed, then "less than or equal to 10" as well as "greater than or equal to 10" is also disclosed. It is also understood that throughout the application data are provided in a number of different formats and that this data represent endpoints and starting points and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Substituted and unsubstituted acyclic units comprising from 1 to 24 carbon atoms encompass 3 categories of units: linear or branched alkyl, non-limiting examples of which include, methyl ($C_1$), ethyl ($C_2$), n-propyl ($C_3$), iso-propyl ($C_3$), n-butyl ($C_4$), sec-butyl ($C_4$), iso-butyl ($C_4$), tert-butyl ($C_4$), and the like; substituted linear or branched alkyl, non-limiting examples of which includes, hydroxymethyl ($C_1$), chloromethyl ($C_1$), trifluoromethyl ($C_1$), aminomethyl ($C_1$), 1-chloroethyl ($C_2$), 2-hydroxyethyl ($C_2$), 1,2-difluoroethyl ($C_2$), 3-carboxypropyl ($C_3$), and the like; linear or branched alkenyl, non-limiting examples of which include, ethenyl ($C_2$), 3-propenyl ($C_3$), 1-propenyl (also 2-methylethenyl) ($C_3$), isopropenyl (also 2-methylethen-2-yl) ($C_3$), buten-4-yl ($C_4$), and the like; substituted linear or branched alkenyl, non-limiting examples of which include, 2-chloroethenyl (also 2-chlorovinyl) ($C_2$), 4-hydroxybuten-1-yl ($C_4$), 7-hydroxy-7-methyloct-4-en-2-yl ($C_9$), 7-hydroxy-7-methyloct-3,5-dien-2-yl ($C_9$), and the like; and linear or branched alkynyl, non-limiting examples of which include, ethynyl ($C_2$), prop-2-ynyl (also propargyl) ($C_3$), propyn-1-yl ($C_3$), and 2-methyl-hex-4-yn-1-yl ($C_7$); substituted linear or branched alkynyl, non-limiting examples of which include, 5-hydroxy-5-methylhex-3-ynyl ($C_7$), 6-hydroxy-6-methylhept-3-yn-2-yl ($C_8$), 5-hydroxy-5-ethylhept-3-ynyl ($C_9$), and the like.

Substituted and unsubstituted cyclic units comprising from 3 to 24 carbon atoms encompass the following units: carbocyclic rings having a single substituted or unsubstituted hydrocarbon ring, non-limiting examples of which include, cyclopropyl ($C_3$), 2-methyl-cyclopropyl ($C_3$), cyclopropenyl ($C_3$), cyclobutyl ($C_4$), 2,3-dihydroxycyclobutyl ($C_4$), cyclobutenyl ($C_4$), cyclopentyl ($C_5$), cyclopentenyl ($C_5$), cyclopentadienyl ($C_5$), cyclohexyl ($C_6$), cyclohexenyl ($C_6$), cycloheptyl ($C_7$), cyclooctanyl ($C_8$), decalinyl ($C_{10}$), 2,5-dimethylcyclopentyl ($C_5$), 3,5-dichlorocyclohexyl ($C_6$), 4-hydroxycyclohexyl ($C_6$), and 3,3,5-trimethylcyclohex-1-yl ($C_6$); carbocyclic rings having two or more substituted or unsubstituted fused hydrocarbon rings, non-limiting examples of which include, octahydropentalenyl ($C_8$), octahydro-1H-indenyl ($C_9$), 3a,4,5,6,7,7a-hexahydro-3H-inden-4-yl ($C_9$), decahydroazulenyl ($C_{10}$); and carbocyclic rings which are substituted or unsubstituted bicyclic hydrocarbon rings, non-limiting examples of which include, bicyclo-[2.1.1]hexanyl, bicyclo[2.2.1]heptanyl, bicyclo[3.1.1]heptanyl, 1,3-dimethyl[2.2.1]heptan-2-yl, bicyclo[2.2.2]octanyl, and bicyclo[3.3.3]undecanyl.

Substituted and unsubstituted aryl units comprising from 6 to 24 carbon atoms encompass the following units: $C_6$, $C_{10}$, or $C_{14}$ substituted or unsubstituted aryl rings; phenyl, naphthyl, anthracenyl, phenanthryl, and the like whether substituted or unsubstituted, non-limiting examples of which include, phenyl ($C_6$), naphthylen-1-yl($C_{10}$), naphthylen-2-yl ($C_{10}$), 4-fluorophenyl ($C_6$), 2-hydroxyphenyl ($C_6$), 3-methylphenyl ($C_6$), 2-amino-4-fluorophenyl ($C_6$), 2-(N,N-diethylamino) phenyl ($C_6$), 2-cyanophenyl ($C_6$), 2,6-di-tert-butylphenyl ($C_6$), 3-methoxyphenyl ($C_6$), 8-hydroxynaphthylen-2-yl ($C_{10}$), 4,5-dimethoxynaphthylen-1-yl ($C_{10}$), and 6-cyanonaphthylen-1-yl ($C_{10}$); $C_6$, $C_{10}$, or $C_{14}$ aryl rings fused with 1 or 2 saturated rings non-limiting examples of which include, bicyclo[4.2.0]octa-1,3,5-trienyl ($C_8$), and indanyl ($C_9$).

Substituted and unsubstituted heterocyclic or heteroaryl units comprising from 1 to 24 carbon atoms encompasses the following units all of which contain at least one heteroatom in at least one ring chosen from nitrogen (N), oxygen (O), sulfur (S), phosphorous (P) or mixtures of N, O, S, and P: heterocyclic units having a single ring containing one or more heteroatoms chosen from nitrogen (N), oxygen (O), or sulfur (S), or mixtures of N, O, and S, non-limiting examples of which include, diazirinyl ($C_1$), aziridinyl ($C_2$), urazolyl ($C_2$), azetidinyl ($C_3$), pyrazolidinyl ($C_3$), imidazolidinyl ($C_3$), oxazolidinyl ($C_3$), isoxazolinyl ($C_3$), isoxazolyl ($C_3$), thiazolidinyl ($C_3$), isothiazolyl ($C_3$), isothiazolinyl ($C_3$), oxathiazolidinonyl ($C_3$), oxazolidinonyl ($C_3$), hydantoinyl ($C_3$), tetrahydrofuranyl ($C_4$), pyrrolidinyl ($C_4$), morpholinyl ($C_4$), piperazinyl ($C_4$), piperidinyl ($C_4$), dihydropyranyl ($C_5$), tetrahydropyranyl ($C_5$), piperidin-2-onyl (valerolactam) ($C_5$), 2,3,4,5-tetrahydro-1H-azepinyl ($C_6$), 2,3-dihydro-1H-indole ($C_8$), and 1,2,3,4-tetrahydro-quinoline ($C_9$); heterocyclic units having 2 or more rings one of which is a heterocyclic ring, non-limiting examples of which include hexahydro-1H-pyrrolizinyl ($C_7$), 3a,4,5,6,7,7a-hexahydro-1H-benzo[d]imidazolyl ($C_7$), 3a,4,5,6,7,7a-hexahydro-1H-indolyl ($C_8$), 1,2,3,4-tetrahydroquinolinyl ($C_9$), and decahydro-1H-cyclooct[b]pyrrolyl ($C_{10}$); heteroaryl rings containing a single ring, non-limiting examples of which include, 1,2,3,4-tetrazolyl ($C_1$), [1,2,3]triazolyl ($C_2$), [1,2,4]triazolyl ($C_2$), triazinyl ($C_3$), thiazolyl ($C_3$), 1H-imidazolyl ($C_3$), oxazolyl ($C_3$), furanyl ($C_4$), thiopheneyl ($C_4$), pyrimidinyl ($C_4$), 2-phenylpyrimidinyl ($C_4$), pyridinyl ($C_5$), 3-methylpyridinyl ($C_5$), and 4-dimethylaminopyridinyl ($C_5$); heteroaryl rings containing 2 or more fused rings one of which is a heteroaryl ring, non-limiting examples of which include: 7H-purinyl ($C_5$), 9H-purinyl ($C_5$), 6-amino-9H-purinyl ($C_5$), 5H-pyrrolo[3,2-d]pyrimidinyl ($C_6$), 7H-pyrrolo[2,3-d]pyrimidinyl ($C_6$), pyrido[2,3-d]pyrimidinyl ($C_7$), 2-phenylbenzo[d]thiazolyl ($C_7$), 1H-indolyl ($C_8$), 4,5,6,7-tetrahydro-1-H-indolyl ($C_8$), quinoxalinyl ($C_8$), 5-methylquinoxalinyl ($C_8$), quinazolinyl ($C_8$), quinolinyl ($C_9$), 8-hydroxy-quinolinyl ($C_9$), and isoquinolinyl ($C_9$).

The term "arylalkylene" is used throughout the specification to refer to substituted or unsubstituted $C_6$, $C_{10}$, or $C_{14}$ aryl rings tethered to another unit through a substituted or unsubstituted $C_1$-$C_{12}$ alkylene unit. These units can be referred to by indicating the number of carbons contained in the alkylene unit followed by the number of carbon atoms in the aryl unit, or by their chemical name. A non-limiting example of tethered cyclic hydrocarbyl units includes a substituted or unsubstituted benzyl. A substituted or unsubstituted benzyl unit contains a tether containing one carbon atom (methylene) and a substituted or unsubstituted aryl ring containing six carbon atoms, or a $C_1$-($C_6$) unit, having the formula:

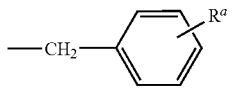

wherein $R^a$ is optionally one or more independently chosen substitutions for hydrogen. Further examples include other aryl units, inter alia, (2-hydroxyphenyl)hexyl $C_6$-($C_6$); naphthalen-2-ylmethyl $C_1$-($C_{10}$), 4-fluorobenzyl $C_1$-($C_6$), 2-(3-hydroxy-phenyl)ethyl $C_2$-($C_6$), as well as substituted and unsubstituted $C_3$-$C_{10}$ alkylenecarbocyclic units, for example, cyclopropylmethyl $C_1$-($C_3$), cyclopentylethyl $C_2$-($C_5$), cyclohexylmethyl $C_1$-($C_6$).

The terms "heteroarylalkylene" and "heterocyclicalkylene" are used throughout the specification to refer to substituted or unsubstituted heteroaryl and heterocyclic rings as defined herein above containing from 1 to 24 carbon atoms that are tethered to another unit through a substituted or unsubstituted $C_1$-$C_{12}$ alkylene unit. These units can be referred to by indicating the number of carbons contained in the alkylene unit followed by the number of carbon atoms in the heteroaryl and heterocyclic unit, or by their chemical name. A non-limiting example includes substituted and unsubstituted $C_1$-$C_{10}$ alkylene-heteroaryl units, for example a 2-picolyl $C_1$-($C_6$) unit having the formula:

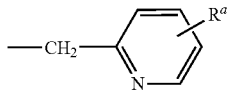

wherein $R^a$ is the same as defined above. In addition, $C_1$-$C_{12}$ tethered cyclic hydrocarbyl units include $C_1$-$C_{10}$ alkyleneheterocyclic units and alkylene-heteroaryl units, non-limiting examples of which include, aziridinylmethyl $C_1$-($C_2$) and oxazol-2-ylmethyl $C_1$-($C_3$).

The term "substituted" is used throughout the specification. The term "substituted" is applied to the units described herein as "substituted unit or moiety is a hydrocarbyl unit or moiety, whether acyclic or cyclic, which has one or more hydrogen atoms replaced by a substituent or several substituents as defined herein below." The units, when substituting for hydrogen atoms are capable of replacing one hydrogen atom, two hydrogen atoms, or three hydrogen atoms of a hydrocarbyl moiety at a time. In addition, these substituents can replace two hydrogen atoms on two adjacent carbons to form said substituent, new moiety, or unit. For example, a substituted unit that requires a single hydrogen atom replacement includes halogen, hydroxyl, and the like. A two hydrogen atom replacement includes carbonyl, oximino, and the like. A two hydrogen atom replacement from adjacent carbon atoms includes epoxy, and the like. A three hydrogen replacement includes cyano, and the like. The term substituted is used throughout the present specification to indicate that a hydrocarbyl moiety, inter alia, aromatic ring, alkyl chain; can have one or more of the hydrogen atoms replaced by a substituent. When a moiety is described as "substituted" any number of the hydrogen atoms may be replaced. For example, 4-hydroxyphenyl is a "substituted aromatic carbocyclic ring (aryl ring)", (N,N-dimethyl-5-amino)octanyl is a "substituted $C_8$ linear alkyl unit, 3-guanidinopropyl is a "substituted $C_3$ linear alkyl unit," and 2-carboxypyridinyl is a "substituted heteroaryl unit."

The following are non-limiting examples of units which can substitute for hydrogen atoms on a carbocyclic, aryl, heterocyclic, or heteroaryl unit:

i) $C_1$-$C_4$ linear or branched alkyl; for example, methyl ($C_1$), ethyl ($C_2$), n-propyl ($C_3$), iso-propyl ($C_3$), n-butyl ($C_4$), iso-butyl ($C_4$), sec-butyl ($C_4$), and tert-butyl ($C_4$);

ii) $—OR^{12}$; for example, —OH, $—OCH_3$, $—OCH_2CH_3$, $—OCH_2CH_2CH_3$;

iii) $—C(O)R^{12}$; for example, $—COCH_3$, $—COCH_2CH_3$, $—COCH_2CH_2CH_3$;

iv) $—C(O)OR^{12}$; for example, $—CO_2CH_3$, $—CO_2CH_2CH_3$, $—CO_2CH_2CH_2CH_3$;

v) $—C(O)N(R^{12})_2$; for example, $—CONH_2$, $—CONHCH_3$, $—CON(CH_3)_2$;

vi) $—N(R^{12})_2$; for example, $—NH_2$, $—NHCH_3$, $—N(CH_3)_2$, $—NH(CH_2CH_3)$;

vii) halogen: —F, —Cl, —Br, and —I;

viii) $—CH_mX_n$; wherein X is halogen, m is from 0 to 2, m+n=3; for example, $—CH_2F$, $—CHF_2$, $—CF_3$, $—CCl_3$, or $—CBr_3$; and ix) $—SO_2R^{12}$; for example, $—SO_2H$; $—SO_2CH_3$; $—SO_2C_6H_5$ wherein each $R^{12}$ is independently hydrogen, substituted or unsubstituted $C_1$-$C_4$ linear, branched, or cyclic alkyl; or two $R^{12}$ units can be taken together to form a ring comprising 3-7 atoms. Substituents suitable for replacement of a hydrogen atom are further defined herein below.

Most aluminum-comprising scrap is recycled through a smelting process. Most of these processes involve melting the scrap in the presence of chloride-based slag, generally using either a reverberatory or rotating furnace. These furnaces operate at temperature of from 800° C. to 900° C. In addition, the added slag or salt cake is typically a eutectic or near-eutectic mixture of sodium and potassium chlorides containing low levels of carrier salts, for example, cryolite, remaining from the smelting process, in addition to other additives. Thus, the smelting process for recovering aluminum metal from waste products requires a large amount of energy in the form of heat to melt the dross and/or slag admixtures. The smelting process itself also produces dross that is typically buried in a landfill.

The disclosed processes provide advantages in recovery of aluminum metal that has not been previously achieved. The disclosed processes and electrolytic cells can be used to accomplish one or more of the following benefits:

A) reducing the cell voltage necessary for electro-winning or electro-refining aluminum metal, for example, reducing the cell voltage used in current industrial processes from a range of about 5 to about 6 volts (V) to a range of from about 1 volt to about 3.5 volts;

B) reducing the energy necessary for electro-winning or electro-refining aluminum metal, for example, reducing the energy used in current industrial processes from a range of about 18 to about 20 kilowatt-hours per kilogram (kW-h/kg) of aluminum to less than about 7 kilowatt-hours per kilogram of aluminum obtained;

C) increasing the cathode current efficiency necessary for electro-winning or electro-refining aluminum metal, for example, increasing the cathode current efficiency used in current industrial processes from a range of about 90 to about 95% to an efficiency greater than about 98%;

D) reducing the current density necessary for electro-winning or electro-refining aluminum metal, for example, reducing the current density used in current industrial processes from a range of about 4000 to about 7000 amperes per square meter ($A/m^2$) to a range of from about 300 to about 600 amperes per square meter;

E) reducing the necessary distance between the cathode and the anode in an electrolytic cell, for example, reducing the electrode distance used in current industrial processes from about 150 to about 180 millimeters (mm) to a distance of from about 10 to about 20 millimeters;

F) reducing the temperature necessary for electro-winning or electro-refining aluminum metal, for example, reducing the cell temperature from a range of about 900 to about 950° C. to a rang of from about 25 to about 100° C.;

G) eliminating the production of toxic gases, for example, eliminating the generation of carbon monoxide (CO), carbon dioxide ($CO_2$), and carbon tetrafluoride ($CF_4$) that is produced by current industrial processes.

Aluminum-Comprising Dross

Aluminum-comprising dross is formed in many ways during the formation of, processing of, recycling of, or use of aluminum. For example, the disclosed dross can be formed during the production, refinement, alloying and casting of aluminum by a reaction between the liquid metal and the air in the atmosphere or by treatment of the aluminum with gasses, the addition of flux, alloy elements, etc. Non-limiting examples of sources of the aluminum-comprising dross include foundry furnaces, holding furnaces, electrolytic furnaces, or a melt treatment unit. The aluminum-comprising dross can comprise from about 40% to about 90% by weight of metallic aluminum, 15-45% by weight of aluminum oxide, while the balance can comprise cryolite, carbides, nitrides, spinel, etc.

During the refining process wherein bauxite is converted to alumina that is subsequently converted to aluminum metal, from about 0.5% to about 10% of the aluminum is lost in the dross. Typically dross comprises metal enclosed in an oxide film that either remains on the surface of the melt, and can thus be skimmed off the top, or as a high density sediment that is left when the liquor is poured off.

Dross can further be formed during the recycling process. During recycling of aluminum, the scrap is sized, compacted, and then re-melted. Dross forms on the top of the liquefied aluminum and is typically removed by skimming.

As used herein "aluminum-comprising dross" means any material that comprises aluminum other than ores, for example, bauxite, cryolite, and the like. Dross is formed by the use, production, recycling, refining, alloying, and casting of aluminum and comprises various salts of aluminum, or aluminum in the form of oxides, nitrides, carbides, and the like. In addition dross can comprise materials carried over from the use of aluminum, especially dross from the recycling of aluminum. For example, the ink used to print the labeling of an aluminum can or container. In addition, the metal dross suitable for use in the disclosed processes and electrolytic cells can comprise up to about 6% by weight of moisture.

For the batch processes disclosed herein, dross is typically preprocessed prior to use, for example, by compacting the dross into a shape or form that is suitable as an electrode. However, it is not necessary to modify the dross as obtained. In one embodiment, dross can be directly connected to a source of voltage and current and used as is as an anode. In addition, as described herein, the dross can be compacted, affixed, or alloyed with a material that serves as an anode once the dross material has been electrolyzed.

For the continuous electro-winning or electro-refining processes disclosed herein, the dross can be pulverized, milled, ground into small particles or a "dust" that can be fed continuously into the electrolytic cell. Because the disclosed electrolyte can sustain up to about 6% by weight of moisture, no further processing of the dross is necessary other than converting the dross into a form that is convenient for handling by the formulator.

Electrolytic Cell

The disclosed batch processes can use an electrolytic cell comprising:

a) one or more cathodes;
b) one or more anodes; and
c) an electrolyte.

One embodiment of the disclosed process, utilizes an electrolytic cell comprising:

a) one or more cathodes;
b) one or more anodes; and
c) an electrolyte comprising:
  i) one or more ionic liquids; and
  ii) one or more carrier salts.

A non-limiting iteration of this embodiment of the disclosed process, utilizes an electrolytic cell comprising:

a) one or more copper cathodes;
b) one or more anodes comprising dross having from about 40% to about 90% by weight of aluminum; and
c) an electrolyte comprising:
  i) 1-methyl-3-butylimidazolium chloride, 1-methyl-3-hexylimidazolium chloride, or a mixture thereof; and
  ii) $AlCl_3$.

A non-limiting example of this iteration of the disclosed process, utilizes an electrolytic cell comprising:

a) one or more copper cathodes;
b) one or more anodes comprising dross having from about 40% to about 90% by weight of aluminum; and
c) an electrolyte comprising:
  i) 1-methyl-3-butylimidazolium chloride, 1-methyl-3-hexylimidazolium chloride, or a mixture thereof; and
  ii) 5 mol/L of $AlCl_3$.

A non-limiting iteration of this embodiment of the disclosed process, utilizes an electrolytic cell comprising:

a) one or more copper cathodes;
b) one or more anodes comprising dross having from about 40% to about 90% by weight of aluminum; and
c) an electrolyte comprising:
  i) 1-methyl-3-butylimidazolium chloride, 1-methyl-3-hexylimidazolium chloride, or a mixture thereof; and
  ii) $Al(OH)_3$.

A non-limiting example of this iteration of the disclosed process, utilizes an electrolytic cell comprising:

a) one or more copper cathodes;
b) one or more anodes comprising dross having from about 40% to about 90% by weight of aluminum; and
c) an electrolyte comprising:
  i) 1-methyl-3-butylimidazolium chloride, 1-methyl-3-hexylimidazolium chloride, or a mixture thereof; and
  ii) 5 mol/L of $Al(OH)_3$.

The disclosed continuous processes can use an electrolytic cell comprising:

a) one or more cathodes;

b) one or more working anodes; and c) an electrolyte.

One embodiment of the disclosed process, utilizes an electrolytic cell comprising:

a) one or more cathodes;

b) one or more working anodes; and c) an electrolyte comprising:

i) one or more ionic liquids; and ii) one or more carrier salts.

A non-limiting iteration of this embodiment of the disclosed process, utilizes an electrolytic cell comprising:

a) one or more copper cathodes;

b) one or more working anodes comprising nickel, chromium, a nickel-chromium alloy, or an alloy of nickel and/or chromium with one or more electrolytically inert materials; and c) an electrolyte comprising:

i) 1-methyl-3-butylimidazolium chloride, 1-methyl-3-hexylimidazolium chloride, or a mixture thereof; and ii) $AlCl_3$.

A non-limiting example of this iteration of the disclosed process, utilizes an electrolytic cell comprising:

a) one or more copper cathodes;

b) one or more working anodes comprising nickel, chromium, a nickel-chromium alloy, or an alloy of nickel and/or chromium with one or more electrolytically inert materials; and c) an electrolyte comprising:

i) 1-methyl-3-butylimidazolium chloride, 1-methyl-3-hexylimidazolium chloride, or a mixture thereof; and ii) 5 mol/L of $AlCl_3$.

A non-limiting iteration of this embodiment of the disclosed process, utilizes an electrolytic cell comprising:

a) one or more copper cathodes;

b) one or more working anodes comprising nickel, chromium, a nickel-chromium alloy, or an alloy of nickel and/or chromium with one or more electrolytically inert materials; and c) an electrolyte comprising:

i) 1-methyl-3-butylimidazolium chloride, 1-methyl-3-hexylimidazolium chloride, or a mixture thereof; and ii) $Al(OH)_3$.

A non-limiting example of this iteration of the disclosed process, utilizes an electrolytic cell comprising:

a) one or more copper cathodes;

b) one or more working anodes comprising nickel, chromium, a nickel-chromium alloy, or an alloy of nickel and/or chromium with one or more electrolytically inert materials; and c) an electrolyte comprising:

i) 1-methyl-3-butylimidazolium chloride, 1-methyl-3-hexylimidazolium chloride, or a mixture thereof; and ii) 5 mol/L of $Al(OH)_3$.

However, variations of electrolytic cells that can be used for the disclosed batch and continuous processes will become apparent to the formulator from the description, examples, figures, and appended claims.

Cathodes

The disclosed electrolytic cells comprise one or more cathodes. The cathode can comprise any material suitable as a surface for electro deposition of aluminum metal. Non-limiting examples of materials suitable for use as cathodes includes aluminum, copper, silicon, nickel, chromium, zinc, and carbon. One embodiment the cathode comprises copper metal. In another embodiment, the cathode comprises an alloy of copper. In a further embodiment the cathode comprises carbon, for example, in the form of graphite. A further embodiment of the cathode comprises zinc. A yet further embodiment comprises silicon.

The cathode can have any shape or configuration, for example, a rod, a mesh, a lattice, or a sheet. In one embodiment, the inner surface of the container that serves as a reservoir for the ionic liquid can serve as the cathode. When the cathode is an inner surface of the reservoir the container itself can comprise any suitable material, for example, metal, a polymeric material, or a composite thereof. For example, the container can comprise a durable polymeric material that is lined with the cathodic material.

One configuration of a cathode is a container comprising a durable, chemically resistant, heat stable polymeric material having a plurality of metal strips along the surface separated from one another. As the aluminum metal is deposited thereon, the surface area of the cathode increases and the result is a cell having a minimal amount of the cathode metal to be removed.

Anodes

The disclosed electrolytic cells can comprise one or more anodes. For batch process wherein the anode is consumed, the anodic material that comprises the electrolytic cell is a metal dross that comprises aluminum metal. The dross can be a mass of solid impurities that comprises aluminum, for example, a dross obtained during the process of recycling aluminum metal. Alternatively the dross can by obtained as a by-product of primary aluminum manufacturing. The dross can have any form, for example, a stamped sheet, a sponge, a perforated plate, or a tapered coil.

In one embodiment, the dross is compacted onto an inert material such that when the dross material is consumed the inert material remains and serves as an anode. This embodiment allows the formulator to continue processing other anodes still comprising dross material while exchanging anodes, or replacing all the consumed electrodes without turning off the voltage source.

Working Electrode

The disclosed continuous processes utilize an electrolytic cell that comprises a working electrode. The working electrode serves as the anode in the cells suitable for use in continuous processes. The working electrode comprises metals or materials that are not susceptible to electrolysis. Non limiting examples or materials suitable as working anodes include nickel, chromium, alloys of nickel and chromium, as well as alloys of nickel with other compatible metals or materials, alloys of chromium with other compatible metals or materials, and alloys of nickel and chromium with other compatible metals or materials. Carbon can also comprise the working electrode. In addition, other additives can be combined with the metals or materials, for example, a material used to anneal the working electrode material.

Reference Electrode

In addition to the one or more cathodes and one or more anodes, the electrolytic cell can comprise a reference electrode. The reference electrode can be used for either batch or continuous process electrolytic cells to assist the formulator in monitoring the voltage and or current that is applied during use. Non limiting examples or materials suitable as reference anodes include nickel, chromium, alloys of nickel and chromium, as well as alloys of nickel with other compatible metals or materials, alloys of chromium with other compatible metals or materials, and alloys of nickel and chromium with other compatible metals or materials. Carbon can also comprise the reference electrode. In addition, other additives can be combined with the metals or materials, for example, a material used to anneal the reference electrode material.

The reference electrode can be fixed into the electrolyte solution or can be withdrawn during the processes. In addition, a plurality of reference electrodes can comprise the disclosed cells.

Cell Configuration

As described herein above, the electrolytic cell can further comprise a housing that comprises an inert material, for example, a metal insulated from the electrolytic current. In a further embodiment the housing can comprise a non-metal, for example, ceramic or glass. In another embodiment the housing or container can comprise a heat stable, chemically stable polymeric material. As described above, the electrolytic cell can be further configured such that the inner surface of the housing serves as a cathode surface or a part of the surface can serve as a cathode. The electrolytic cell can also be configured such that the electro reduction is conducted under an inert atmosphere, for example, under nitrogen, argon, and the like.

For continuous processes, the cell can be configured in a manner such that dross can be added to the electrolyte either as a continuous feed, or the cell can be configured such that a bolus of dross can be added at a time the formulator desires. The electrolytic cells can be configured to operate on a continuous basis wherein additional dross comprising anodes are added as the process continues, or the electrolytic cell can operate as a batch electrolytic cell.

The surface area of the electrodes disclosed herein can be any amount determined by the formulator. For aluminum-comprising dross anodes, the surface area can be smooth or irregular. In the case of irregular or highly irregular surfaces, the surface area of the electrode can be difficult to accurately ascertain. However, no configuration or amount of surface area is excluded from the disclosed electrodes.

Electrolyte

The disclosed electrolytic cells comprise an electrolyte comprising one or more ionic liquids. Ionic liquids are a class of solvents composed of ionized species in contrast to traditional organic or aqueous solvents which are molecular non-ionics. Ionic liquids are salts that exist in the liquid phase at a temperature from about −70° C. to about 300° C. The ionic liquids of the present disclosure comprise an organic cation and an organic or inorganic anion. The organic cation is typically formed by alkylation of a neutral organic species capable of holding a positive charge when a suitable anion is present.

The organic cation of the ionic liquids disclosed herein can comprise a linear, branched, or cyclic heteroalkyl unit. The term "heteroalkyl" refers to a cation as disclosed herein comprising one or more heteroatoms chosen from nitrogen, oxygen, sulfur, boron, or phosphorous capable of forming a cation. The heteroatom can be a part of a ring formed with one or more other heteroatoms, for example, pyridinyl, imidazolinyl rings, that can have substituted or unsubstituted linear or branched alkyl units attached thereto. In addition, the cation can be a single heteroatom wherein a sufficient number of substituted or unsubstituted linear or branched alkyl units are attached to the heteroatom such that a cation is formed. For example, the ionic liquid tributylmethyl phosphonium dimethyl-phosphate having the formula:

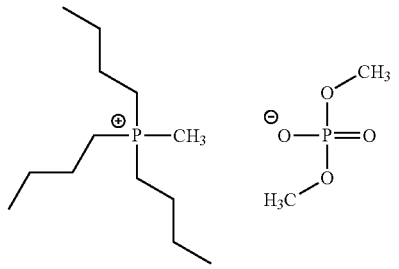

is an example of an ionic liquid wherein the heteroalkyl cation comprising linear alkyl units; three n-butyl ($C_4$) units and one methyl ($C_1$) unit. N-Ethyl-3-methyl-pyridinium ethylsulfate having the formula:

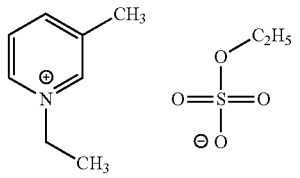

is an example of an ionic liquid comprising a cyclic heteroalkyl cation; a ring comprising 5 carbon atoms and 1 nitrogen atom. When more than one quaternizable heteroatom is present in a ring, only one heteroatom is alkylated.

Non-limiting examples of heterocyclic and heteroaryl units that can be alkylated to form cationic units include imidazole, pyrazoles, thiazoles, isothiazoles, azathiozoles, oxothiazoles, oxazines, oxazolines, oxazaboroles, dithiozoles, triazoles, selenozoles, oxahospholes, pyrroles, boroles, furans, thiphenes, phospholes, pentazoles, indoles, indolines, oxazoles, isothirazoles, tetrazoles, benzofurans, dibenzofurans, benzothiophenes, dibenzothoiphenes, thiadiazoles, pyrdines, pyrimidines, pyrazines, pyridazines, piperazines, piperidines, morpholines, pyrans, annolines, phthalazines, quinazolines, and quinoxalines.

The following are examples of heterocyclic units that are suitable for forming a cyclic heteroalkyl cation unit of the disclosed ionic liquids:

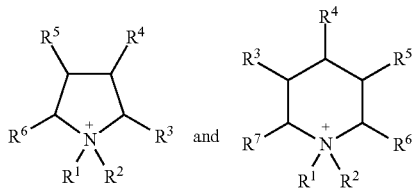

pyrrolidinium and piperidinium

The following are further examples of heterocyclic units that are suitable for forming a cyclic heteroalkyl cation unit of the disclosed ionic liquids:

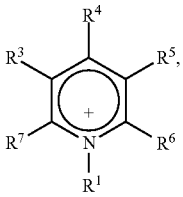

pyridinium

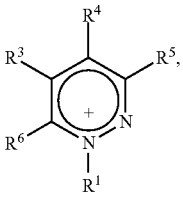

pyridazinium

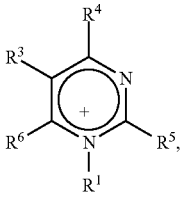

pyrimidinium

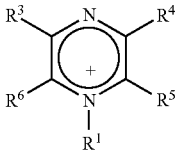

pyrazinium

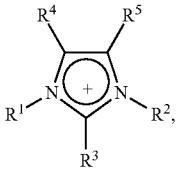

imidazolium

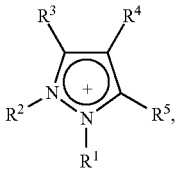

pyrazolium

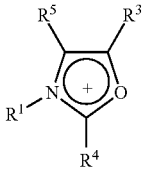

oxazolium

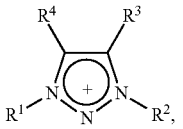

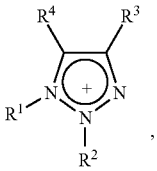

1,2,3-triazolium

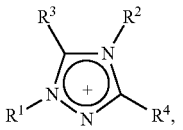

1,2,4-triazolium

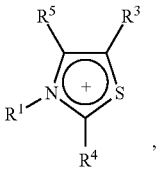

thiazolium

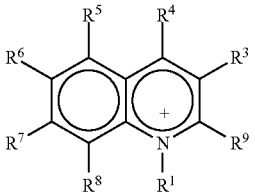

and quinolium

-continued

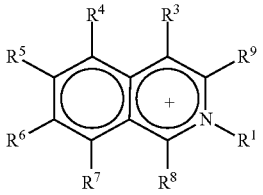

isoquinolium where each $R^1$ and $R^2$ is, independently, a substituted or unsubstituted linear, branched, or cyclic $C_1$-$C_6$ alkyl, or substituted or unsubstituted linear, branched, or cyclic $C_1$-$C_6$ alkoxy; each $R^3$, $R^4$, $R^5$, $R^6$, $R^7$, $R^8$, and $R^9$ is, independently, hydrogen, substituted or unsubstituted linear, branched, or cyclic $C_1$-$C_6$ alkyl, substituted or unsubstituted linear, branched, or cyclic $C_1$-$C_6$ alkoxy, or substituted or unsubstituted linear or branched, $C_1$-$C_6$ alkoxyalkyl.

The following comprises yet another set of examples of heterocyclic units that are suitable for forming heterocyclic dication units of the disclosed ionic liquids and are referred to as such or as "geminal ionic liquids:" See Armstrong, D. W. et al., Structure and properties of high stability geminal dicationic ionic liquids, *J. Amer. Chem. Soc.* 2005; 127(2):593-604; and Rogers, R. D. et al., Mercury(II) partitioning from aqueous solutions with a new, hydrophobic ethylene-glycol functionalized bis-imidazolium ionic liquid, *Green Chem.* 2003; 5:129-135 included herein by reference in its entirety.

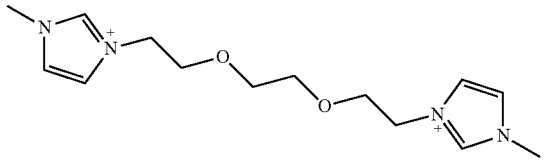

1,1'-[1,2-ethanediylbis(oxy-1,2-ethanediyl)]bis[3-methyl-1H-imidazolium-1-yl]

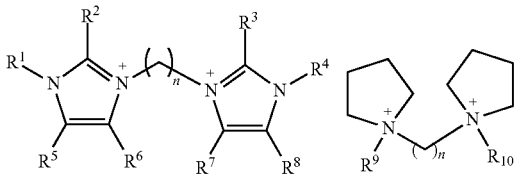

n = 3, 6, 9, 12 n = 3, 9 imidazolium and pyrrolidinium based di-cations where $R^1$, $R^4$, $R^9$, and $R^{10}$ comprise a substituted or unsubstituted linear, branched, or cyclic $C_1$-$C_6$ alkyl, or substituted or unsubstituted linear, branched, or cyclic $C_1$-$C_6$ alkoxy; each $R^5$, $R^6$, $R^7$, and $R^8$ is, independently, hydrogen, substituted or unsubstituted linear, branched, or cyclic $C_1$-$C_6$ alkyl, substituted or unsubstituted linear, branched, or cyclic $C_1$-$C_6$ alkoxy, or substituted or unsubstituted linear or branched, $C_1$-$C_6$ alkoxyalkyl.

The anionic portion of the ionic liquid can comprise an inorganic or organic moiety. Non-limiting examples of anions include inorganic anions: halogens, (i.e., F, Cl, Br, and I);

borides, $BX_4$, wherein X represents halogen, (i.e., $BF_4$, $BCl_4$), and the like; phosphates(V), $PX_6$; $PF_6$, and the like; arsenate(V), $AsX_6$; $AsF_6$, and the like; stibate(V) (antimony), $SbX_6$; $SbF_6$, and the like; $CO_3^{2}$; $NO_2$, $NO_3$, $SO_4^{2}$, and $(CF_3)SO_3$.

Other non-limiting examples of ionic liquid anions include substituted azolates, that is, five membered heterocyclic aromatic rings that have nitrogen atoms in either positions 1 and 3 (imidazolates); 1, 2, and 3 (1,2,3-triazolates); or 1, 2, 4 (1,2,4-triazolate). Substitutions to the ring occur at positions that are not located in nitrogen positions (these are carbon positions) and include CN (cyano), $NO_2$ (nitro), and $NH_2$ (amino) group appended to the heterocyclic azolate core.

Further non-limiting examples of anions include substituted or unsubstituted borides: $B(R^{10})_4$; substituted or unsubstituted sulfates: $(R^{10}O)S(=))_2O$; substituted or unsubstituted acyl units $R^{10}CO_2$, for example, acetate $CH_3CO_2$, proprionate, $CH_3CH_2CO_2$, butyrate $CH_3CH_2CH_2CO_2$, and benzylate, $C_6H_5CO_2$; substituted or unsubstituted phosphates: $(R^{10}O)_2P(=O)O$; substituted or unsubstituted carboxylates: $(R^{10}O)C(=O)O$; substituted or unsubstituted azolates wherein the azolate can be substituted on a carbon atom by a unit chosen from cyano, nitro, and amino. Non-limiting examples of $R^{10}$ include hydrogen; substituted or unsubstituted linear branched, and cyclic alkyl; substituted or unsubstituted linear, branched, and cyclic alkoxy; substituted or unsubstituted aryl; substituted or unsubstituted aryloxy; substituted or unsubstituted heterocyclic; substituted or unsubstituted heteroaryl; acyl; silyl; boryl; phosphino; amino; thio; and seleno.

One embodiment of ionic liquids comprise an anion chosen from Cl, Br, I, $(CF_3)SO_3$, $(R^{10}O)S(=O)_2O$; $(R^{10}O)_2P(=O)O$; $(R^{10}O)C(=O)O$; and $R^{10}CO_2$; each $R^{10}$ is independently $C_1$-$C_4$ alkyl. Anions that are chosen from Cl, Br, I, and $R^{10}CO_2$ have been found to be convenient in forming the compositions of step (a) in the compositions and processes disclosed herein.

The following is a description of the short hand method used throughout the specification for referring to the imidazolium-based ionic liquids disclosed herein. The template:

$[C_n mim]$ represents the cation portion of the ionic liquid wherein $C_n$ represent an alkyl or substituted alkyl moiety having n number of carbon atoms. The term "mim" refers to "methyl substituted imidazolium." Referring to the generic imidazolium formula:

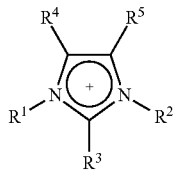

wherein $R^3$, $R^4$, and $R^5$ are each hydrogen, can also be written as follows:

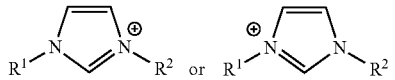

wherein either nitrogen can be depicted as having a positive charge. By the convention used herein the methyl group of "mim" refers to the $R^1$ moiety and the $C_n$ substituent is the $R^2$ moiety. Therefore $[C_4\ min]$ represents a cation having the formula:

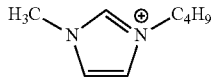

which can be equally well represented by the formula:

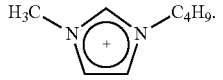

The anion portion of the ionic liquid is written without the charge, for example, Cl and $PF_6$.

The following are non-limiting examples of ionic liquids written in the short hand convention with the corresponding formula:

i) $[C_4mim]Cl$ having the formula:

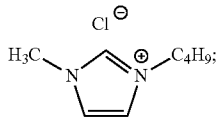

ii) $[C_2mim](C_2H_5O)SO_3$ having the formula:

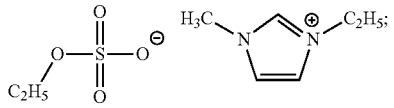

iii) $[C_4mim]Cl$ having the formula:

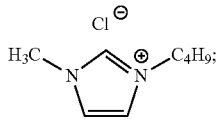

iv) $[C_2mim]Cl$ having the formula:

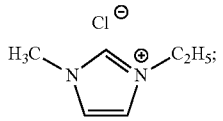

v) $[C_2mim](C_2H_5O)_2PO_2$ having the formula:

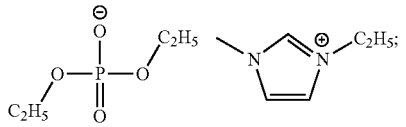

vi) $[C_4mim]BF_4$ having the formula:

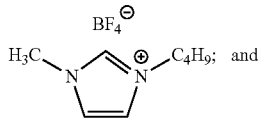

vii) $[C_4mim]PF_6$ having the formula:

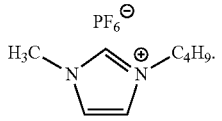

In one embodiment, the electrolytic cell comprises an ionic liquid wherein the anion of the ionic liquid is chloride ion. In another embodiment, the ionic liquid comprises a cation having the formula:

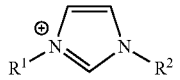

wherein $R^1$ and $R^2$ are each independently methyl, ethyl, n-propyl, iso-propyl, n-butyl, iso-butyl, n-pentyl, or n-hexyl. Non-limiting examples of cations include 1-methyl-3-methylimidazolium, 1-methyl-3-ethylimidazolium, 1-methyl-3-propylimidazolium, 1-methyl-3-butylimidazolium, 1-methyl-3-pentylimidazolium, 1-methyl-3-hexylimidazolium, 1-ethyl-3-methylimidazolium, 1-ethyl-3-ethylimidazolium, 1-ethyl-3-propylimidazolium, 1-ethyl-3-butylimidazolium, 1-ethyl-3-pentylimidazolium, 1-ethyl-3-hexylimidazolium, 1-propyl-3-methylimidazolium, 1-propyl-3-ethylimidazolium, 1-propyl-3-propylimidazolium, 1-propyl-3-butylimidazolium, 1-propyl-3-pentylimidazolium, 1-propyl-3-hexylimidazolium, 1-butyl-3-methylimidazolium, 1-butyl-3-ethylimidazolium, 1-butyl-3-propylimidazolium, 1-butyl-3-butylimidazolium, 1-butyl-3-pentylimidazolium, 1-butyl-3-hexylimidazolium, and 1-hexyl-3-methylimidazolium.

Non-limiting examples of ionic liquids suitable for use in the disclosed electrolytic cells include 1-methyl-3-methylimidazolium chloride, 1-methyl-3-ethylimidazolium chloride, 1-methyl-3-propylimidazolium chloride, 1-methyl-3-butylimidazolium chloride, 1-methyl-3-pentylimidazolium chloride, 1-methyl-3-hexyl-imidazolium chloride, 1-ethyl-3-methylimidazolium chloride, 1-ethyl-3-ethylimidazolium chloride, 1-ethyl-3-propylimidazolium chloride, 1-ethyl-3-butylimidazolium chloride, 1-ethyl-3-pentylimidazolium chloride, 1-ethyl-3-hexylimidazolium chloride, 1-propyl-3-methyl-imidazolium chloride, 1-propyl-3-ethylimidazolium chloride, 1-propyl-3-propylimidazolium chloride, 1-propyl-3-butylimidazolium chloride, 1-propyl-3-pentylimidazolium chloride, 1-propyl-3-hexylimidazolium chloride, 1-butyl-3-methylimidazolium chloride, 1-butyl-3-ethyl-imidazolium chloride, 1-butyl-3-propylimidazolium chloride, 1-butyl-3-butylimidazolium chloride, 1-butyl-3-pentylimidazolium chloride, 1-butyl-3-hexylimidazolium chloride, and 1-hexyl-3-methylimidazolium chloride.

One example of an electrolytic cell comprises 1-butyl-3-methylimidazolium chloride. In another example, the electrolytic cell comprises 1-hexyl-3-methylimidazolium chloride. In a further example, the electrolytic cell comprises an admixture of 1-butyl-3-methylimidazolium chloride and 1-hexyl-3-methylimidazolium chloride.

The disclosed ionic liquids have the advantage that up to about 6% by weight of moisture can be introduced into the electrolyte by the dross. This fact allows the formulator options for the amount of pre-processing the dross or in the selection of a carrier salt if the formulator chooses that the cell comprise one or more carrier salts.

Carrier Salts

In addition to the ionic liquids, the electrolyte can comprise one or more carrier salts that provide either a seed source of aluminum or provide a second means for current flow between electrodes. Carrier salts have the advantage of being compatible with the disclosed ionic liquids over the full range of operable temperatures. Non-limiting examples of carrier salts include aluminum chloride ($AlCl_3$), aluminum hydroxide ($Al(OH)_3$), aluminum oxide (alumina, $Al_2O_3$), sodium aluminum fluoride ($Na_3AlF_6$), aluminum sulfate ($Al_2(SO_4)_3$), aluminum phosphate ($AlPO_4$), aluminum borate ($AlBO_3$), aluminum acetate ($Al(CH_3CO_2)_3$), and aluminum nitrate ($Al(NO_2)_3$).

The electrolyte solution can comprise from 0.01% to about 50% by weight of one or more aluminum salts. In one embodiment, the electrolyte solution comprises from about 0.5% to about 10% by weight of one or more aluminum salts. In another embodiment, the electrolyte solution comprises from about 5% to about 25% by weight of one or more aluminum salts.

In a further embodiment, the electrolyte solution comprises from about 1% to about 5% by weight of one or more aluminum salts. In a still further embodiment, the electrolyte solution comprises from about 10% to about 20% by weight of one or more aluminum salts.

The amount of aluminum that comprises the electrolyte solution can also be expressed as the $Al^{3+}$ concentration. The electrolyte solution can comprise from about 0.1 mol/L to about 20 mol/L of aluminum ($Al^{3+}$). In one embodiment, the electrolyte solution can comprise from about 1 mol/L to about 10 mol/L of aluminum. In another embodiment, the electrolyte solution can comprise from about 3 mol/L to about 7 mol/L of aluminum. One example of the electrolyte solution comprises 5 mol/L of aluminum. However, the solution can comprise any amount of an aluminum carrier salt, for example, 0.5 mol/L, 1 mol/L, 1.5 mol/L, 2 mol/L, 2.5 mol/L, 3 mol/L, 3.5 mol/L, 4 mol/L, 4.5 mol/L, 5 mol/L, 5.5 mol/L, 6 mol/L, 6.5 mol/L, 7 mol/L, 7.5 mol/L, 8 mol/L, 8.5 mol/L, 9 mol/L, 9.5 mol/L, and 10 mol/L. The amounts and ranges also include any fractional amounts or concentrations, for example, 0.42% and 4.7 mol/L.

Process

The processes of the present disclosure provide a low temperature, low energy usage process for obtaining aluminum metal in enhanced purity over currently used industrial processes. The amount of energy used in the disclosed processes is lower than conventional processes, inter alia, Hall-Heroult process that typically requires from about 18 to about 20 kilowatt-hours per kilogram of material processed. In addition, as described herein, the temperature necessary to recover aluminum in the disclosed processes is lower than conventional processes thereby saving the energy needed to heat the processed material.

Further, conventional processes for recovering aluminum from dross rely on extensive processing of the dross, heating, and the like. In addition, these conventional process themselves, unlike the disclosed processes, produce dross that is typically discarded and is thus wasteful of aluminum resources.

The electrical potential (electromotive force, emf) applied across the electrodes of the disclosed electrolytic cell is measured in volts and is referred to herein as voltage. The voltage used in the disclosed process for electrolyzing an aluminum-comprising dross is from about 0.1 volts to about 10 volts. In one embodiment, the voltage applied to the 0.15 electrolytic cell is from 1 volt to about 3 volts. In another embodiment, the voltage applied to the electrolytic cell is from 0.5 volt to about 5 volts. In a further embodiment, the voltage applied to the electrolytic cell is from 2 volt to about 4 volts. In a yet further embodiment, the voltage applied to the electrolytic cell is from 2.5 volt to about 3.5 volts. In a still further embodiment, the voltage applied to the electrolytic cell is from 1 volt to about 3.5 volts. However, the voltage can be any amount, for example, 0.5 volts, 1 volts, 1.5 volts, 2 volts, 2.5 volts, 3 volts, 3.5 volts, 4 volts, 4.5 volts, 5 volts, 5.5 volts, 6 volts, 6.5 volts, 7 volts, 7.5 volts, 8 volts, 8.5 volts, 9 volts, 9.5 volts, and 10 volts. The amount of voltage also includes any fractional amounts, for example, 0.33 volts, 1.9 volts, 2.9 volts, 3.1 volts and 5.01 volts.

The amount of current that flows across the disclosed electrodes is expressed herein as either current (amperes, amps, A) or as current density expressed in amperes/$m^2$ ($A/m^2$). The current density can be from about 10 $A/m^2$ to about 1000 $A/m^2$. In one embodiment, the current density is from about 100 $A/m^2$ to about 500 $A/m^2$. In another embodiment, the current density is from about 300 $A/m^2$ to about 600 $A/m^2$. In a further embodiment, the current density is from about 200 $A/m^2$ to about 400 $A/m^2$. In a yet further embodiment, the current density is from about 250 $A/m^2$ to about 500 $A/m^2$. In still further embodiment, the current density is from about 400 $A/m^2$ to about 700 $A/m^2$. However, the current density can be any amount, for example, 100 $A/m^2$, 150 $A/m^2$, 200 $A/m^2$, 250 $A/m^2$, 300 $A/m^2$, 350 $A/m^2$, 400 $A/m^2$, 450 $A/m^2$, 500 $A/m^2$, 550 $A/m^2$, and 600 $A/m^2$. The current density also includes any fractional amounts, for example, 310 $A/m^2$, 396.5 $A/m^2$, 452 $A/m^2$, 5503.75 $A/m^2$, and 599.99 $A/m^2$.

The disclosed processes can be carried out at a temperature of from about 25° C. to about 100° C. In one embodiment, the temperature is from about 80° C. to about 100° C. In another embodiment, the temperature is from about 30° C. to about 50° C. In a further embodiment, the temperature is from about 40° C. to about 60° C. In a yet further embodiment, the temperature is from about 50° C. to about 80° C. In still further embodiment, the temperature is from about 25° C. to about 50° C. However, the process can be carried out at any temperature from about 25° C. to about 100° C., for example, 25° C., 26° C., 27° C., 28° C., 29° C., 30° C., 31° C., 32° C., 33° C., 34° C., and 35° C., or any fractional value thereof.

The purity of the aluminum deposited at the cathode has a purity of from about 90% to about 99.99%. In one embodiment, the purity is from about 95% to about 99.9%. In a further embodiment, the purity is from about 99.7% to about 99.99%. Example of aluminum purities that can be obtained by the disclosed process include 99.5%, 99.6%, 99.7%, 99.8%, 99.9%, 99.991%, 99.92%, 99.93%, 99.94%, 99.95%, 99.96%, and 99.97%.

Batch Process

The disclosed batch processes for obtaining aluminum metal from dross, comprise:

a) providing an electrolytic cell having at least one anode comprising an aluminum-comprising dross, at least one cathode, and an electrolyte; and b) applying an electrical potential between the anode and cathode such that aluminum is deposited on the cathode.

One embodiment of the disclosed batch process comprises:

a) providing an electrolytic cell comprising:

i) one or more anodes comprising an aluminum-comprising dross;

ii) one or more cathodes comprising a material chosen from aluminum, copper, silicon, zinc, or carbon, or an alloy or a mixture thereof;

iii) one or more ionic liquids chosen from 1-methyl-3-butylimidazolium chloride and 1-methyl-3-hexyl-imidazolium chloride, 1-ethyl-3-methylimidazolium chloride, 1-ethyl-3-ethylimidazolium chloride, 1-ethyl-3-propylimidazolium chloride, 1-ethyl-3-butylimidazolium chloride, 1-ethyl-3-pentylimidazolium chloride, 1-ethyl-3-hexylimidazolium chloride, 1-propyl-3-methyl-imidazolium chloride, 1-propyl-3-ethylimidazolium chloride, 1-propyl-3-propylimidazolium chloride, 1-propyl-3-butylimidazolium chloride, 1-propyl-3-pentylimidazolium chloride, 1-propyl-3-hexylimidazolium chloride, 1-butyl-3-methylimidazolium chloride, 1-butyl-3-ethyl-imidazolium chloride, 1-butyl-3-propylimidazolium chloride, 1-butyl-3-butylimidazolium chloride, 1-butyl-3-pentylimidazolium chloride, 1-butyl-3-hexylimidazolium chloride, or 1-hexyl-3-methylimidazolium chloride; and iv) one or more carrier salts chosen from aluminum chloride ($AlCl_3$), aluminum hydroxide ($Al(OH)_3$), aluminum oxide (alumina, $Al_2O_3$), sodium aluminum fluoride ($Na_3AlF_6$), aluminum sulfate ($Al_2(SO_4)_3$), aluminum phosphate ($AlPO_4$), aluminum borate ($AlBO_3$), aluminum acetate ($Al(CH_3CO_2)_3$), and aluminum nitrate ($Al(NO_2)_3$);

b) applying an electrical potential of from about 0.1 volts to about 10 volts across the anode and cathode; and c) depositing aluminum metal onto the cathode.

Another embodiment of the disclosed batch process comprises:

a) providing an electrolytic cell comprising:

i) one or more anodes comprising an aluminum-comprising dross;

ii) one or more cathodes comprising copper;

iii) one or more ionic liquids chosen from 1-methyl-3-butylimidazolium chloride and 1-methyl-3-hexyl-imidazolium chloride; and iv) one or more carrier salts chosen from aluminum chloride ($AlCl_3$) and aluminum hydroxide ($Al(OH)_3$);

b) applying an electrical potential of from about 1 volt to about 3.5 volts across the anode and cathode; and c) depositing aluminum metal onto the cathode.

A still other embodiment of the disclosed batch process comprises:

a) providing an electrolytic cell comprising:

i) one or more anodes comprising an aluminum-comprising dross;

ii) one or more cathodes comprising copper;

iii) 1-methyl-3-butylimidazolium chloride; and iv) aluminum chloride ($AlCl_3$);

b) applying an electrical potential of from about 1 volt to about 3.5 volts across the anode and cathode; and c) depositing aluminum metal onto the cathode;

wherein the purity of the aluminum deposited thereon is greater than about 99.5%.

Another embodiment of the disclosed batch process comprises:

a) providing an electrolytic cell comprising:
   i) one or more anodes comprising an aluminum-comprising dross;
   ii) one or more cathodes comprising copper;
   iii) 1-methyl-3-hexyl-imidazolium chloride; and
   iv) aluminum chloride ($AlCl_3$);
b) applying an electrical potential of from about 1 volt to about 3.5 volts across the anode and cathode; and
c) depositing aluminum metal onto the cathode;

wherein the purity of the aluminum deposited thereon is greater than about 99.5%

A still other embodiment of the disclosed batch process comprises:

a) providing an electrolytic cell comprising:
   i) one or more anodes comprising an aluminum-comprising dross;
   ii) one or more cathodes comprising copper;
   iii) 1-methyl-3-butylimidazolium chloride; and
   iv) aluminum hydroxide ($Al(OH)_3$);
b) applying an electrical potential of from about 1 volt to about 3.5 volts across the anode and cathode; and
c) depositing aluminum metal onto the cathode;

wherein the purity of the aluminum deposited thereon is greater than about 99.5%.

Another embodiment of the disclosed batch process comprises:

a) providing an electrolytic cell comprising:
   i) one or more anodes comprising an aluminum-comprising dross;
   ii) one or more cathodes comprising copper;
   iii) 1-methyl-3-hexyl-imidazolium chloride; and
   iv) aluminum hydroxide ($Al(OH)_3$);
b) applying an electrical potential of from about 1 volt to about 3.5 volts across the anode and cathode; and
c) depositing aluminum metal onto the cathode;

wherein the purity of the aluminum deposited thereon is greater than about 99.5%

A yet further embodiment of the disclosed batch process comprises:

a) providing an electrolytic cell having at least one anode comprising an aluminum-comprising dross, a cathode, and an electrolyte; and
b) applying an electrical bias between the anode and cathode at a temperature of from about 25° C. to about 100° C. such that aluminum is deposited on the cathode.

A still further embodiment of the disclosed batch process comprises:

a) providing an electrolytic cell having at least one anode comprising aluminum-comprising dross, a cathode, and an electrolyte; and
b) passing an electrical current through the electrolyte wherein the current density at the cathode is 10 $A/m^2$ to about 1000 $A/m^2$ such that aluminum is deposited on the cathode.

One yet further embodiment of the disclosed batch process comprises:

a) providing an electrolytic cell comprising:
   i) one or more anodes comprising an aluminum-comprising dross;
   ii) one or more cathodes comprising a material chosen from aluminum, copper, silicon, zinc, or carbon, or an alloy or a mixture thereof;
   iii) one or more ionic liquids chosen from 1-methyl-3-butylimidazolium chloride and 1-methyl-3-hexyl-imidazolium chloride, 1-ethyl-3-methylimidazolium chloride, 1-ethyl-3-ethylimidazolium chloride, 1-ethyl-3-propylimidazolium chloride, 1-ethyl-3-butylimidazolium chloride, 1-ethyl-3-pentylimidazolium chloride, 1-ethyl-3-hexylimidazolium chloride, 1-propyl-3-methyl-imidazolium chloride, 1-propyl-3-ethylimidazolium chloride, 1-propyl-3-propylimidazolium chloride, 1-propyl-3-butylimidazolium chloride, 1-propyl-3-pentylimidazolium chloride, 1-propyl-3-hexylimidazolium chloride, 1-butyl-3-methylimidazolium chloride, 1-butyl-3-ethyl-imidazolium chloride, 1-butyl-3-propylimidazolium chloride, 1-butyl-3-butylimidazolium chloride, 1-butyl-3-pentylimidazolium chloride, 1-butyl-3-hexylimidazolium chloride, or 1-hexyl-3-methylimidazolium chloride; and
   iv) one or more carrier salts chosen from aluminum chloride ($AlCl_3$), aluminum hydroxide ($Al(OH)_3$), aluminum oxide (alumina, $Al_2O_3$), sodium aluminum fluoride ($Na_3AlF_6$), aluminum sulfate ($Al_2(SO_4)_3$), aluminum phosphate ($AlPO_4$), aluminum borate ($AlBO_3$), aluminum acetate ($Al(CH_3CO_2)_3$), and aluminum nitrate ($Al(NO_2)_3$);
b) applying an electrical potential of from about 0.1 volts to about 10 volts across the anode and cathode and an amount of electrical current such that the current density at the electrodes is from about 10 $A/m^2$ to about 1000 $A/m^2$, at a temperature of from about 25° C. to about 100° C.; and
c) depositing aluminum metal onto the cathode wherein the purity of the aluminum deposited thereon is greater than about 99.5%.

Continuous Process

The continuous processes are convenient for large operations wherein a series of electrolytic cells are used to process bulk dross. The dross is delivered to the electrolyte where it either dissolves or is electrolytically separated. For continuous processes, the cathodes can be exchanged without stopping the flow of current through the cell.

In one embodiment, the aluminum-comprising dross is pulverized and sorted by size using sieves. The finer sized pulverized dross can be admixed with the electrolyte prior to beginning the process. This small particle size dross serves as an "aluminum seed" in the electrolytic process. The larger particle size dross can then be added to the electrolyte solution once deposition of aluminum metal begins.

The disclosed continuous processes for obtaining aluminum metal from dross, comprise:

a) providing an electrolytic cell having at least one working anode comprising an electrolytically stable material, at least one cathode, and an electrolyte comprising aluminum-comprising dross; and
b) applying an electrical potential between the anode and cathode such that aluminum is deposited on the cathode.

One embodiment of the disclosed process comprises:

a) providing an electrolytic cell comprising:
   i) one or more anodes comprising nickel, chromium, alloys of nickel and chromium, as well as alloys of nickel with other compatible metals or materials, alloys of chromium with other compatible metals or materials, and alloys of nickel and chromium with other compatible metals or materials;
   ii) one or more cathodes comprising a material chosen from aluminum, copper, silicon, zinc, or carbon, or an alloy or a mixture thereof;
   iii) one or more ionic liquids chosen from 1-methyl-3-butylimidazolium chloride and 1-methyl-3-hexyl-imidazolium chloride, 1-ethyl-3-methylimidazolium chloride, 1-ethyl-3-ethylimidazolium chloride, 1-ethyl-3-propylimidazolium chloride, 1-ethyl-3-butylimidazolium chloride, 1-ethyl-3-pentylimidazolium chloride, 1-ethyl-3-hexylimidazolium chloride, 1-propyl-3-methyl-imidazolium chloride, 1-propyl-3-ethylimidazolium chloride, 1-propyl-3-propylimidazolium chloride, 1-propyl-3-butylimidazolium chloride, 1-propyl-3-pentylimidazolium chloride, 1-propyl-3-hexylimidazolium chloride, 1-butyl-3-methylimidazolium chloride, 1-butyl-3-ethyl-imidazolium chloride, 1-butyl-3-propylimidazolium chloride, 1-butyl-3-butylimidazolium chloride, 1-butyl-3-pentylimidazolium chloride, 1-butyl-3-hexylimidazolium chloride, or 1-hexyl-3-methylimidazolium chloride;

iv) one or more carrier salts chosen from aluminum chloride ($AlCl_3$), aluminum hydroxide ($Al(OH)_3$), aluminum oxide (alumina, $Al_2O_3$), sodium aluminum fluoride ($Na_3AlF_6$), aluminum sulfate ($Al_2(SO_4)_3$), aluminum phosphate ($AlPO_4$), aluminum borate ($AlBO_3$), aluminum acetate ($Al(CH_3CO_2)_3$), and aluminum nitrate ($Al(NO_2)_3$); and v) a source of aluminum-comprising dross;

b) applying an electrical potential of from about 0.1 volts to about 10 volts across the anode and cathode while continuously adding to the electrolyte a source of aluminum-comprising dross; and c) depositing aluminum metal onto the cathode.

Another embodiment of the disclosed process comprises:

a) providing an electrolytic cell comprising:

i) one or more anodes comprising nickel, chromium, or an alloy thereof;

ii) one or more cathodes comprising copper;

iii) one or more ionic liquids chosen from 1-methyl-3-butylimidazolium chloride and 1-methyl-3-hexyl-imidazolium chloride;

iv) one or more carrier salts chosen from aluminum chloride ($AlCl_3$) and aluminum hydroxide ($Al(OH)_3$); and v) aluminum-comprising dross;

b) applying an electrical potential of from about 1 volt to about 3.5 volts across the anode and cathode while continuously adding a source of aluminum-comprising dross to the electrolyte; and c) depositing aluminum metal onto the cathode.

A still other embodiment of the disclosed process comprises:

a) providing an electrolytic cell comprising:

i) one or more anodes comprising nickel, chromium, or an alloy thereof;

ii) one or more cathodes comprising copper;

iii) 1-methyl-3-butylimidazolium chloride;

iv) aluminum chloride ($AlCl_3$); and v) aluminum-comprising dross;

b) applying an electrical potential of from about 1 volt to about 3.5 volts across the anode and cathode; and c) continuously adding a source of aluminum-comprising dross while depositing aluminum metal onto the cathode;

wherein the purity of the aluminum deposited thereon is greater than about 99.5%.

Another embodiment of the disclosed process comprises:

a) providing an electrolytic cell comprising:

i) one or more anodes comprising nickel, chromium, or an alloy thereof;

ii) one or more cathodes comprising copper;

iii) 1-methyl-3-hexyl-imidazolium chloride;

iv) aluminum chloride ($AlCl_3$); and v) aluminum-comprising dross;

b) applying an electrical potential of from about 1 volt to about 3.5 volts across the anode and cathode; and c) continuously adding a source of aluminum-comprising dross while continuously depositing aluminum metal onto the cathode;

wherein the purity of the aluminum deposited thereon is greater than about 99.5%

A yet further embodiment of the disclosed process comprises:

a) providing an electrolytic cell having at least one anode comprising one or more anodes comprising nickel, chromium, or an alloy thereof, a cathode, and an electrolyte comprising aluminum-comprising dross; and b) applying an electrical bias between the anode and cathode at a temperature of from about 25° C. to about 100° C. while continuously adding a source of aluminum-comprising dross such that aluminum is continuously deposited on the cathode.

A still further embodiment of the disclosed process comprises:

a) providing an electrolytic cell having at least one anode comprising one or more anodes comprising nickel, chromium, or an alloy thereof, a cathode, and an electrolyte comprising aluminum-comprising dross; and b) passing an electrical current through the electrolyte wherein the current density at the cathode is 10 $A/m^2$ to about 1000 $A/m^2$ while continuously adding a source of aluminum-comprising dross such that aluminum is continuously deposited on the cathode.

One yet further embodiment of the disclosed process comprises:

a) providing an electrolytic cell comprising:

i) one or more anodes comprising nickel, chromium, or an alloy thereof;

ii) one or more cathodes comprising a material chosen from aluminum, copper, silicon, zinc, or carbon, or an alloy or a mixture thereof;

iii) one or more ionic liquids chosen from 1-methyl-3-butylimidazolium chloride and 1-methyl-3-hexyl-imidazolium chloride, 1-ethyl-3-methylimidazolium chloride, 1-ethyl-3-ethylimidazolium chloride, 1-ethyl-3-propylimidazolium chloride, 1-ethyl-3-butylimidazolium chloride, 1-ethyl-3-pentylimidazolium chloride, 1-ethyl-3-hexylimidazolium chloride, 1-propyl-3-methyl-imidazolium chloride, 1-propyl-3-ethylimidazolium chloride, 1-propyl-3-propylimidazolium chloride, 1-propyl-3-butylimidazolium chloride, 1-propyl-3-pentylimidazolium chloride, 1-propyl-3-hexylimidazolium chloride, 1-butyl-3-methylimidazolium chloride, 1-butyl-3-ethyl-imidazolium chloride, 1-butyl-3-propylimidazolium chloride, 1-butyl-3-butylimidazolium chloride, 1-butyl-3-pentylimidazolium chloride, 1-butyl-3-hexylimidazolium chloride, or 1-hexyl-3-methylimidazolium chloride;

iv) one or more carrier salts chosen from aluminum chloride ($AlCl_3$), aluminum hydroxide ($Al(OH)_3$), aluminum oxide (alumina, $Al_2O_3$), sodium aluminum fluoride ($Na_3AlF_6$), aluminum sulfate ($Al_2(SO_4)_3$), aluminum phosphate ($AlPO_4$), aluminum borate ($AlBO_3$), aluminum acetate ($Al(CH_3CO_2)_3$), and aluminum nitrate ($Al(NO_2)_3$); and v) aluminum-comprising dross;

b) applying an electrical potential of from about 0.1 volts to about 10 volts across the anode and cathode and an amount of electrical current such that the current density at the electrodes is from about 10 $A/m^2$ to about 1000 $A/m^2$, at a temperature of from about 25° C. to about 100° C. while continuously adding a source of aluminum-comprising dross such that aluminum metal is continuously deposited on the cathode;

wherein the purity of the aluminum deposited thereon is greater than about 99.5%.

A still other embodiment of the disclosed process comprises:

a) providing an electrolytic cell comprising:
   i) one or more anodes comprising nickel, chromium, or an alloy thereof;
   ii) one or more cathodes comprising copper;
   iii) 1-methyl-3-butylimidazolium chloride;
   iv) aluminum hydroxide ($Al(OH)_3$); and
   v) aluminum-comprising dross;
b) applying an electrical potential of from about 1 volt to about 3.5 volts across the anode and cathode; and
c) continuously adding a source of aluminum-comprising dross while depositing aluminum metal onto the cathode;

wherein the purity of the aluminum deposited thereon is greater than about 99.5%.

Another embodiment of the disclosed process comprises:

a) providing an electrolytic cell comprising:
   i) one or more anodes comprising nickel, chromium, or an alloy thereof;
   ii) one or more cathodes comprising copper;
   iii) 1-methyl-3-hexyl-imidazolium chloride;
   iv) aluminum hydroxide ($Al(OH)_3$); and
   v) aluminum-comprising dross;
b) applying an electrical potential of from about 1 volt to about 3.5 volts across the anode and cathode; and
c) continuously adding a source of aluminum-comprising dross while continuously depositing aluminum metal onto the cathode;

wherein the purity of the aluminum deposited thereon is greater than about 99.5%

Without wishing to be limited by theory, one example of the electro-winning or electro-refining reactions that can occur in an electrolytic cell comprising an aluminum-comprising dross anode and an electrolyte comprising aluminum chloride is as follows:

$$Al^0(\text{dross})+7AlCl_4^- \rightarrow 4Al_2Cl_7^-+3e^- \qquad \text{ANODE REACTION}$$

$$4Al_2Cl_7^-+3e^- \rightarrow Al^0(\text{deposited on cathode})+7AlCl_4^- \qquad \text{CATHODE REACTION}$$

However, other reactions wherein the aluminum, which comprises the aluminum-comprising dross is in the form of a salt, can also afford aluminum deposited on the cathode.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure. All cited references are included herein by reference in their entirety.

What is claimed is:

1. A process for recovering aluminum metal from an aluminum-comprising dross, the process comprising:

a) providing the dross, wherein the dross is formed from a reaction of liquid aluminum metal with air and is skimmed from the aluminum metal;
b) providing an electrolytic cell having at least one anode comprising the aluminum-comprising dross, at least one cathode, and an electrolyte, wherein the electrolyte comprises an ionic liquid and one or more carrier salt that comprises aluminum ion, wherein the ionic liquid comprises an imidazolium cation; and
c) applying an electrical potential between the anode and cathode such that aluminum metal is deposited on the cathode surface.

2. A process according to claim 1, wherein the cathode comprises aluminum, copper, silicon, zinc, carbon, or a mixture or alloy thereof.

3. A process according to claim 1, wherein the ionic liquid comprises an anion chosen from $F^-$; $Cl^-$; $Br^-$; $I^-$; $BX_4^-$, $PX_6^-$, $AsX_6^-$, and $SbX_6^-$ wherein X represents F, Cl, Br, or I; $CO_3^{2-}$; $NO_2^-$; $NO_3^-$; $SO_4^{2-}$; $(CF_3)SO_3^-$, $R^{10}CO_2^-$, wherein $R^{10}$ is $C_1$-$C_{10}$ linear, branched or cyclic alkyl.

4. A process according to claim 1, wherein the ionic liquid comprises a cation chosen from 1-methyl-3-methylimidazolium, 1-methyl-3-ethylimidazolium, 1-methyl-3-propylimidazolium, 1-methyl-3-butylimidazolium, 1-methyl-3-pentyl-imidazolium, 1-methyl-3-hexylimidazolium, 1-ethyl-3-methylimidazolium, 1-ethyl-3-ethylimidazolium, 1-ethyl-3-propylimidazolium, 1-ethyl-3-butylimidazolium, 1-ethyl-3-pentyl-imidazolium, 1-ethyl-3-hexylimidazolium, 1-propyl-3-methylimidazolium, 1-propyl-3-ethylimidazolium, 1-propyl-3-propylimidazolium, 1-propyl-3-butylimidazolium, 1-propyl-3-pentylimidazolium, 1-propyl-3-hexylimidazolium, 1-butyl-3-methyl-imidazolium, 1-butyl-3-ethylimidazolium, 1-butyl-3-propylimidazolium, 1-butyl-3-butylimidazolium, 1-butyl-3-pentylimidazolium, 1-butyl-3-hexylimidazolium, and 1-hexyl-3-methylimidazolium.

5. A process according to claim 1, wherein the ionic liquid comprises an anion chosen from $F^-$; $Cl^-$; $Br^-$; $I^-$; $PF_6^-$, $CO_3^{2-}$; $SO_4^{2-}$; $(CF_3)SO_3^-$, $CH_3CO_2^-$, $CH_3CH_2CO_2^-$, $CH_3CH_2CH_2CO_2^-$, and $CH_3CH_2CH_2CH_2CO_2^-$.

6. A process according to claim 1, wherein the ionic liquid is chosen from 1-methyl-3-methylimidazolium chloride, 1-methyl-3-ethylimidazolium chloride, 1-methyl-3-propylimidazolium chloride, 1-methyl-3-butylimidazolium chloride, 1-methyl-3-pentylimidazolium chloride, 1-methyl-3-hexyl-imidazolium chloride, 1-ethyl-3-methylimidazolium chloride, 1-ethyl-3-ethylimidazolium chloride, 1-ethyl-3-propylimidazolium chloride, 1-ethyl-3-butylimidazolium chloride, 1-ethyl-3-pentylimidazolium chloride, 1-ethyl-3-hexylimidazolium chloride, 1-propyl-3-methyl-imidazolium chloride, 1-propyl-3-ethylimidazolium chloride, 1-propyl-3-propylimidazolium chloride, 1-propyl-3-butylimidazolium chloride, 1-propyl-3-pentylimidazolium chloride, 1-propyl-3-hexylimidazolium chloride, 1-butyl-3-methylimidazolium chloride, 1-butyl-3-ethyl-imidazolium chloride, 1-butyl-3-propylimidazolium chloride, 1-butyl-3-butylimidazolium chloride, 1-butyl-3-pentylimidazolium chloride, 1-butyl-3-hexylimidazolium chloride, and 1-hexyl-3-methylimidazolium chloride.

7. A process according to claim 1, wherein the carrier salt is chosen from, aluminum oxide, aluminum hydroxide, sodium aluminum fluoride, aluminum sulfate, aluminum phosphate, aluminum borate, aluminum acetate, and aluminum nitrate.

8. A process according to claim 1, wherein the carrier salt comprises aluminum chloride and the concentration of aluminum chloride in the electrolyte is from about 0.5% to about 10% by weight.

9. A process according to claim 1, wherein the carrier salt comprises aluminum chloride and the concentration of aluminum chloride in the electrolyte is from about 10% to about 20% by weight.

10. A process according to claim 1, wherein the carrier salt comprises aluminum hydroxide and the concentration of aluminum hydroxide in the electrolyte is from about 0.5% to about 10% by weight.

11. A process according to claim 1, wherein the carrier salt comprises aluminum hydroxide and the concentration of aluminum hydroxide in the electrolyte is from about 10% to about 20% by weight.

12. A process according to claim 1, wherein the electrolyte comprises from about 3 mol/L to about 7 mol/L of aluminum ($Al^{3+}$).

13. A process according to claim 1, wherein the electrical potential applied is from about 0.1 volts to about 10 volts.

14. A process according to claim 1, wherein the current density is from about 10 $A/m^2$ to about 1000 $A/m^2$.

15. A process for recovering aluminum metal from an aluminum-comprising dross, the process comprising:

a) providing the dross, wherein the dross is formed from a reaction of liquid aluminum metal with air and is skimmed from the aluminum metal;

b) providing an electrolytic cell comprising:

i) one or more anodes comprising the aluminum-comprising dross;

ii) one or more cathodes comprising copper or aluminum;

iii) an electrolyte comprising one or more ionic liquids chosen from 1-methyl-3-butylimidazolium chloride, 1-methyl-3-hexylimidazolium chloride, or a mixture of 1-methyl-3-butylimidazolium chloride and 1-methyl-3-hexylimidazolium chloride; and from one or more carrier salts chosen from aluminum chloride or aluminum hydroxide;

c) applying an electrical potential of from about 1 volt to about 3.5 volts across the anode and cathode to have aluminum metal deposited onto the cathode, wherein the aluminum-comprising dross comprises about 40 to about 90% by weight aluminum metal and about 15 to about 45% by weight aluminum oxide.

16. A process according to claim 1, wherein the electrolytic cell further comprises a reference electrode.

17. A process according to claim 1, wherein the deposition of aluminum on the cathode surface is conducted under an inert atmosphere.

18. A process according to claim 1, wherein the distance between the cathode and the anode is from about 10 mm to about 20 mm.

19. The process of claim 1, wherein the aluminum-comprising dross comprises about 40 to about 90% by weight aluminum metal and about 15 to about 45% by weight aluminum oxide.

20. The process of claim 1, wherein additional aluminum-comprising dross is added to the anode during the aluminum recovery process without interrupting the process.

21. The process of claim 1, wherein the anode comprises nickel, chromium, or an alloy thereof as a working electrode with the aluminum-comprising dross covering at least part of the working electrode.

22. The process of claim 1, wherein the electrolyte sustains up to about 6% by weight of moisture.

23. The process of claim 1, wherein the aluminum metal deposited at the cathode has a purity of from about 90 to about 99.99%.

24. The process of claim 1, wherein the aluminum metal deposited at the cathode has a purity greater than about 99.5%.

25. The process of claim 1, wherein ionic liquid comprises 1-hexyl-3-methylimidazolium chloride.

26. The process of claim 1, wherein the electrolyte comprises from about 0.5% to about 10% by weight a carrier salt that comprises aluminum ion.

27. The process of claim 1, wherein the electrolyte comprises from about 5% to about 25% by weight a carrier salt that comprises aluminum ion.

28. The process of claim 15, wherein additional aluminum-comprising dross is added to the anode during the aluminum recovery process without interrupting the process.

29. The process of claim 15, wherein the anode comprises nickel, chromium, or an alloy thereof as a working electrode with the aluminum-comprising dross covering at least part of the working electrode.

30. The process of claim 15, wherein the electrolyte contains up to about 6% by weight of moisture.

* * * * *